United States Patent [19]

Stuart

[11] Patent Number: 5,026,088

[45] Date of Patent: Jun. 25, 1991

[54] SNOWBOARD SAFETY STRAP

[75] Inventor: Robert B. Stuart, Medford, Oreg.

[73] Assignee: Squeeze Lock, Inc.

[21] Appl. No.: 359,527

[22] Filed: Jun. 1, 1989

[51] Int. Cl.[5] ..... A63C 11/00

[52] U.S. Cl. ..... 280/637; 280/14.2; 280/814; 294/147; 441/74

[58] Field of Search ..... 280/14.2, 14.3, 637, 280/814, 600, 601, 607, 627, 634, 618; 441/74; 294/147

[56] References Cited

U.S. PATENT DOCUMENTS

| | | | |
|---|---|---|---|
| 2,933,324 | 4/1960 | Stimler | 280/637 |
| 2,959,424 | 11/1960 | Richards | 280/637 |
| 3,091,011 | 5/1963 | Campbell | 280/814 |
| 3,489,424 | 1/1970 | Gertsch et al. | 280/618 |
| 3,590,608 | 7/1971 | Smyth | 280/814 |
| 3,647,234 | 3/1972 | Gertsch | 280/637 |
| 3,714,803 | 2/1973 | Chenenko | 280/814 |
| 3,716,248 | 2/1973 | Wiley | 280/627 |
| 3,727,934 | 4/1973 | Averbrook et al. | 280/814 |
| 3,765,694 | 10/1973 | Allsop | 280/637 |
| 3,791,663 | 2/1974 | Allsop et al. | 280/637 |
| 3,796,438 | 3/1974 | Zimmet | 280/637 |
| 3,826,510 | 7/1974 | Halter | 280/637 |
| 3,838,585 | 10/1974 | Foote | 280/814 |
| 3,874,685 | 4/1975 | Von Besser | 280/618 |
| 3,931,656 | 1/1976 | Thomson | 280/637 |
| 3,947,927 | 4/1976 | Rosenthal | 280/814 |
| 3,959,995 | 6/1976 | Fletcher | 70/18 |
| 3,994,511 | 11/1976 | Gronseth | 280/637 |
| 3,999,410 | 12/1976 | Hall | 70/58 |
| 4,185,361 | 1/1980 | Stuart | 70/58 |
| 4,231,586 | 11/1980 | Krause | 280/637 |
| 4,820,220 | 4/1989 | Fruzzetti et al. | 441/74 |
| 4,867,478 | 9/1989 | Anderson | 280/814 |

FOREIGN PATENT DOCUMENTS

| | | | |
|---|---|---|---|
| 562873 | 10/1932 | Fed. Rep. of Germany | 280/637 |
| 1182562 | 11/1964 | Fed. Rep. of Germany | 280/637 |
| 1428882 | 3/1969 | Fed. Rep. of Germany | 280/637 |
| 2504367 | 8/1976 | Fed. Rep. of Germany | 280/637 |
| 1028689 | 5/1953 | France | 280/637 |
| 2383682 | 11/1978 | France | 280/637 |
| 360933 | 4/1962 | Switzerland | 280/620 |

OTHER PUBLICATIONS

*Action Now*, Jan. 1982, vol. 8, No. 6.

Snowster, Sno-Tek Publication.

Kemper Advertisement in Snowboarding Magazine, vol. 2, No. 4.

*Primary Examiner*—David M. Mitchell

*Attorney, Agent, or Firm*—Kolisch, Hartwell, Dickinson, McCormack & Heuser

[57] ABSTRACT

The safety strap of the invention includes a fastener which is secured to a snowboard, and a length of cable, having a loop at each end thereof. One of the loops is secured to the fastener while the other end has an attachment device secured to it. A leg strap is worn by a snowboard user. The strap is secured about the user's leg and has a connection thereon for receiving the attachment device at the other end of the cable.

4 Claims, 3 Drawing Sheets

SNOWBOARD SAFETY STRAP

BACKGROUND OF THE INVENTION

This invention relates to safety straps for sports equipment, and specifically to a safety strap which is particularly suited for use with a snowboard.

The snowboard recreation device has become quite popular in recent years. A snowboard is essentially a cross between a ski and a surfboard and includes a substantially flat board, which may have a wooden or composite core and a smooth, slippery bottom surface. A pair of bindings is located on the top of the board with the major axes of the binding, i.e., those axes which parallel the axes of the feet of the user, extending at a near 45° angle to the major, long axes of the snowboard.

One of the main uses to which snowboards are put is that of aerial acrobatics. As such, the bindings on a snowboard are not designed to release easily in the event of a fall, as are the bindings on conventional cross country or downhill skis. There is, nevertheless, concern that under certain circumstances the user may separate from the board, resulting in a snowboarder going in one direction while his snowboard goes in another. To this end, many winter recreation areas require the use of a safety strap on snowboards.

As with skis, snowboards are subject to theft. For this reason, a safety strap which provides a means for locking the snowboard to a fixed object is thought to be particularly advantageous.

A snowboard may weigh approximately 15 to 30 pounds, and be four to five feet in length. Carrying such an object is awkward. A carrying strap is of particular utility on a snowboard, but the provision of a permanent carrying strap or handle may create a hazardous condition if the strap or handle becomes entangled in brush or tree limbs.

SUMMARY OF THE INVENTION

An object of the invention is to provide a snowboard safety strap which will retain a snowboard in the general vicinity of the snowboard user should the user's feet slip out of the bindings on a snowboard.

Another object of the invention is to provide a safety strap which may be affixed between the snowboard and the snowboard user in several configurations, allowing for a relatively shorter or relatively longer length of cable to remain free.

Another object of the invention is to provide a snowboard safety strap which provides a theft prevention device for the snowboard.

Yet another object of the invention is to provide a snowboard safety which may be used a carrying strap for a snowboard.

A further object of the invention is to provide a snowboard safety strap which may be retrofit installed on snowboards, is easy and inexpensive to manufacture, and provides the requisite safety features of such a device.

The safety strap of the invention includes a fastener, which is secured to a snowboard, and a length of cable, having a loop at each end thereof. One of the loops is secured to the fastener while the other end has an attachment device secured to it. A leg strap is worn by a snowboard user. The strap is secured about the user's leg and has a connection thereon for receiving the attachment device at the other end of the cable.

These and other objects and advantages of the invention will become more fully apparent as the description which follows is read in conjunction with the drawings.

DESCRIPTION OF THE DRAWINGS

FIG. I is a plan view of the snowboard safety strap of the invention, depicted in situ connected to a snowboard.

DETAILED DESCRIPTION OF THE PREFERRED EMBODIMENTS

Figures 1, 4, 5:
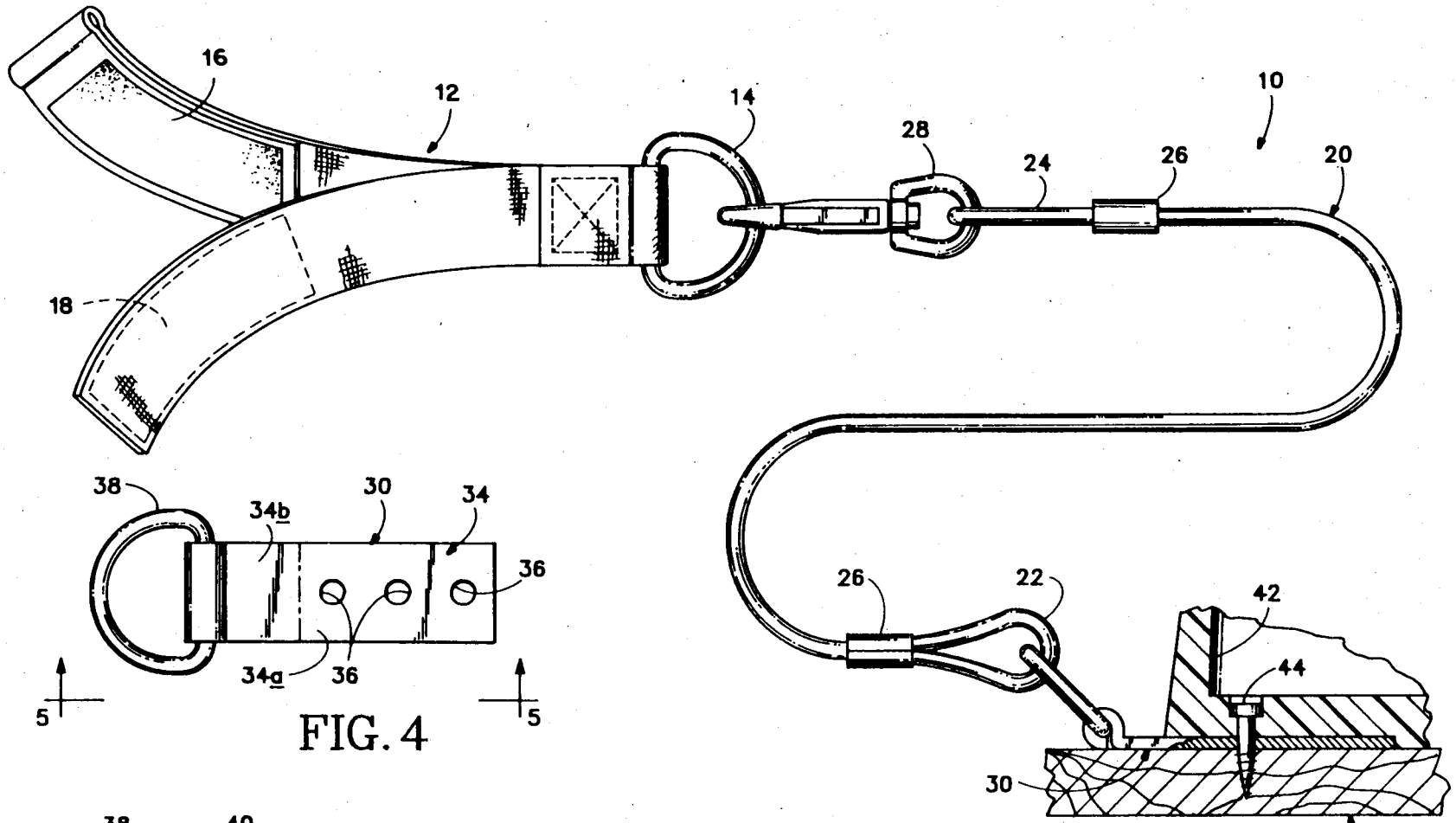
FIG. 4 is a top plan view of one form of a safety strap fastener constructed according to the invention.
FIG. 5 is a side plan view of the fastener, taken generally along the line 5—5 of FIG. 4.

Turning now to the drawings, and initially to FIG. 1, a snowboard safety strap constructed according to the invention is shown generally at 10. Safety strap 10 includes an elongate web 12, also referred to herein as a leg strap. Web 12 is folded at a point intermediate its ends and forms a passage, through which a D-ring 14 is secured. Stitching maintains D-ring 14 in a desired position.

Loop-and-hook fasteners are located at 16 and 18 and provide a closure mechanism for the strap which allows for an adjustable-length closure about the user's leg.

A cable 20 is provided with a loop 22 at one end thereof and a loop 24 at the other end thereof. The cable loops are fixed by means of swaged or crimped bindings 26. Cable 20 is substantially non-elastic and may be formed of what is known as aircraft cable. The cable is generally provided with a plastic coating of some form to prevent abrasion to either the snowboard, snowboard bindings or the users, when same come in contact with the cable.

A snap 28 is fixed to cable 20 on loop 24. Snap 28, also referred to herein as an attachment device, provides an easy, yet secure method of attaching cable 20 to web 12.

Referring now to FIGS. 1, 4 and 5, a fastener 30 is depicted. Fastener 30 is used to connect cable 20 to a snowboard, such as that shown in fragment at 32. Fastener 30 includes a metal tab 34 which has a first portion 34*a*, which is designed to contact the upper surface 32*a* of a snowboard and which has plural bores, such as bores 36 formed therein. Bores 36 are used to secure tab 34 to a snowboard. A second portion 34*b* is provided, and, in the preferred embodiment, has a D-ring 38 secured in a loop 40, formed in second portion 34*b*. D-ring 38, also referred to herein as a connector, provides a means of attaching loop 22 in cable 20 to fastener 30. In certain circumstances, it may be desirable to connect loop 22 through a bore or grommet formed in second portion 34*b*, thereby eliminating loop 40 and D-ring 38.

Referring now to FIG. 1, a binding 42 is depicted secured to snowboard 32 by means of a screw 44. Screw 44 may be seen to pass through a bore 36 in first portion 34*a* of fastener 30. A number of bores 36 are provided in fastener 30 so that the fastener may be secured between the binding and snowboard with as little of the surface of the first portion 34*a* as possible exposed. Covering as much of surface 34*a* as possible provides additional strength to the connection of the safety strap to the snowboard and eliminates undesirable protrusion of edges outside of the binding.

Figure 2:
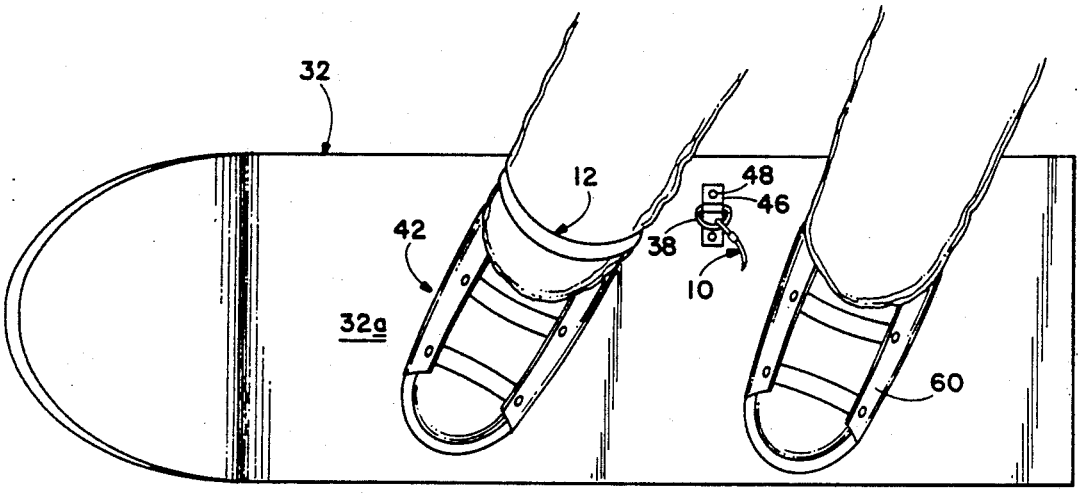
FIG. 2 is a top plan view of a snowboard with a slightly modified form of the safety strap attached thereto.

Referring momentarily to FIG. 2, a snowboard is depicted wherein a modified form of a fastener 46 is depicted. In this form of the fastener, a pair of bores is provided to allow passage of screws 48 directly into the snowboard. Screws 48 may be of the one-way type, which readily allow driving but which are not removable with a conventional screwdriver. This type of fastener may be used with a snowboard binding which does not readily permit installation as described in conjunction with FIG. 1.

It should be noted that the fastener of the safety strap is secured between the snowboard and the front binding thereon or, as close as possible to the rear of the front binding. There are several reasons for this type of installation. One reason is because it is believed that the forces that are applied to the bindings on a snowboard are much greater on the rear bindings than on the front bindings and the likelihood of the front binding separating from the snowboard is less than that of the rear bindings separating from the snowboard. Additionally, a snowboarder frequently will remove his rear foot from the rear binding in order to propel the snowboard, in the same manner as is used by skateboarders. This one-foot propelling technique is particularly useful when the snowboarder is getting to a lift pickup. As the snowboarder mounts the lift, one foot—the forward foot—is received in the front binding of the snowboard while the rear foot is out of the binding.

Figure 3:
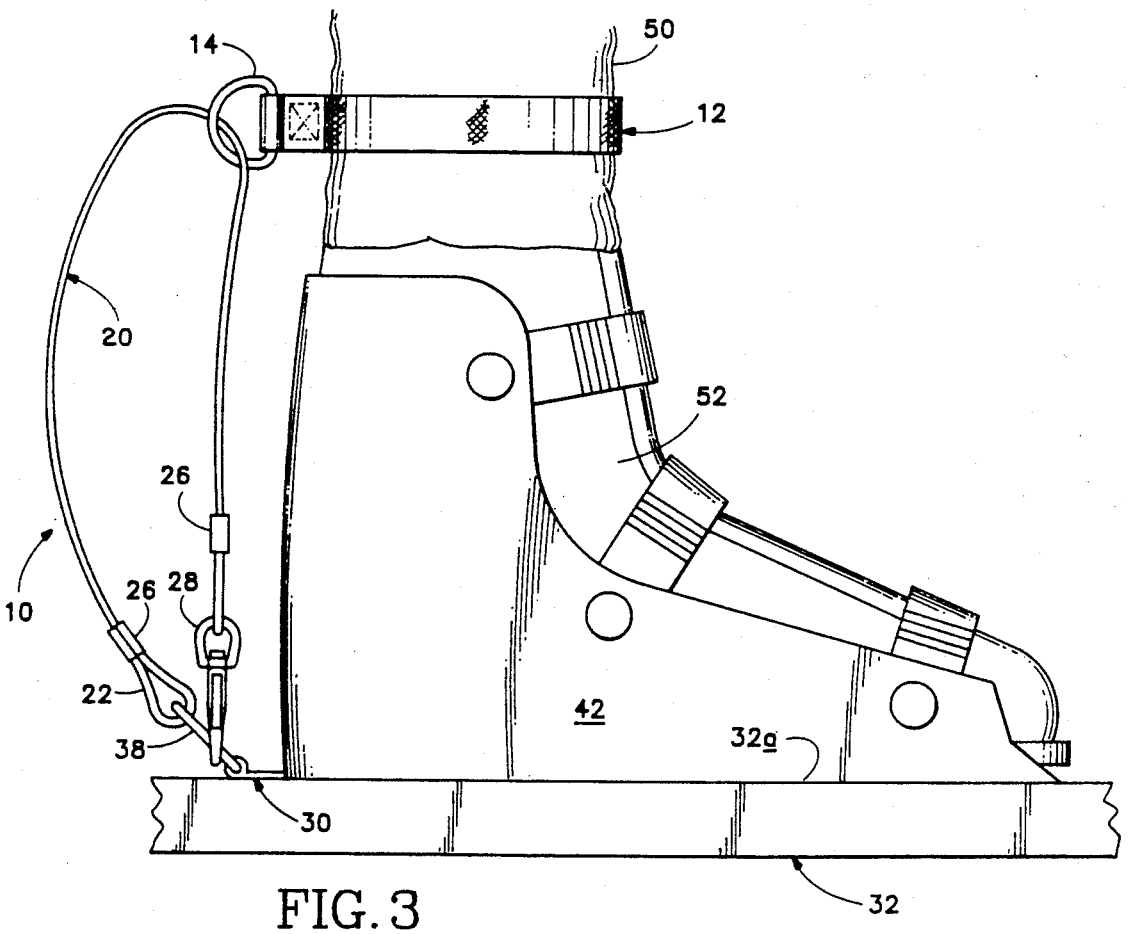
FIG. 3 is a side view of a snowboard binding and a safety strap constructed according to the invention.
Figure 7:
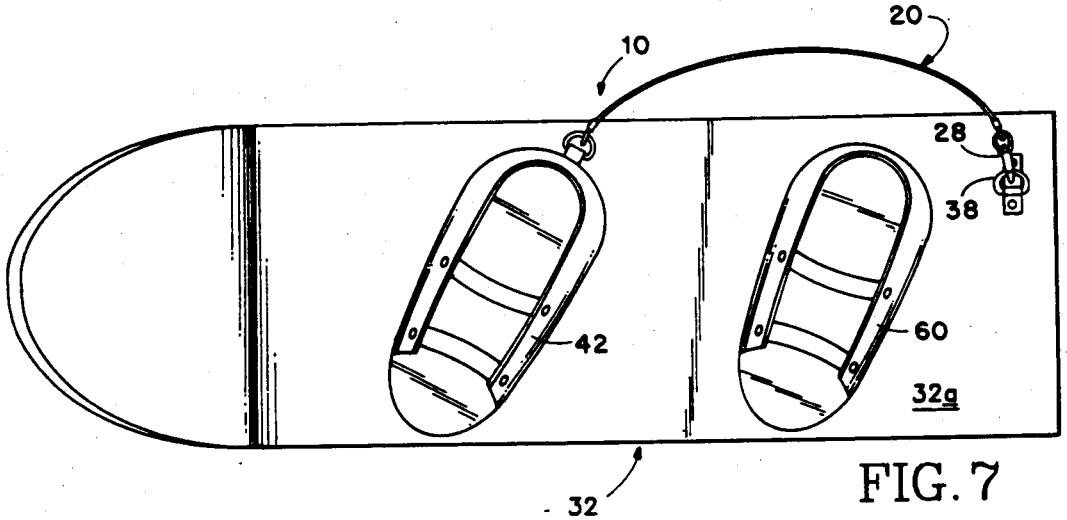
FIG. 7 is a view depicting the safety strap of the invention used as a carrying strap.

Referring now to FIG. 3, a leg 50 and foot (encased in a boot) 52 of a user are depicted along with snowboard 32 and safety strap 10. It may be seen that cable 20 extends from fastener 30 through D-ring 14 on web 12 and back down toward the snowboard, where snap 28 is connected to D-ring 38. This arrangement provides for very little slack in cable 20 while the cable is in use. This provides less free cable to become entangled in limbs and other objects which may be partially sticking out of the snow. Although it would be feasible to provide a shorter cable and clip snap 28 directly to D-ring 14, a shorter cable would not allow for the additional utility which the safety strap of the invention enjoys.

Figure 6:
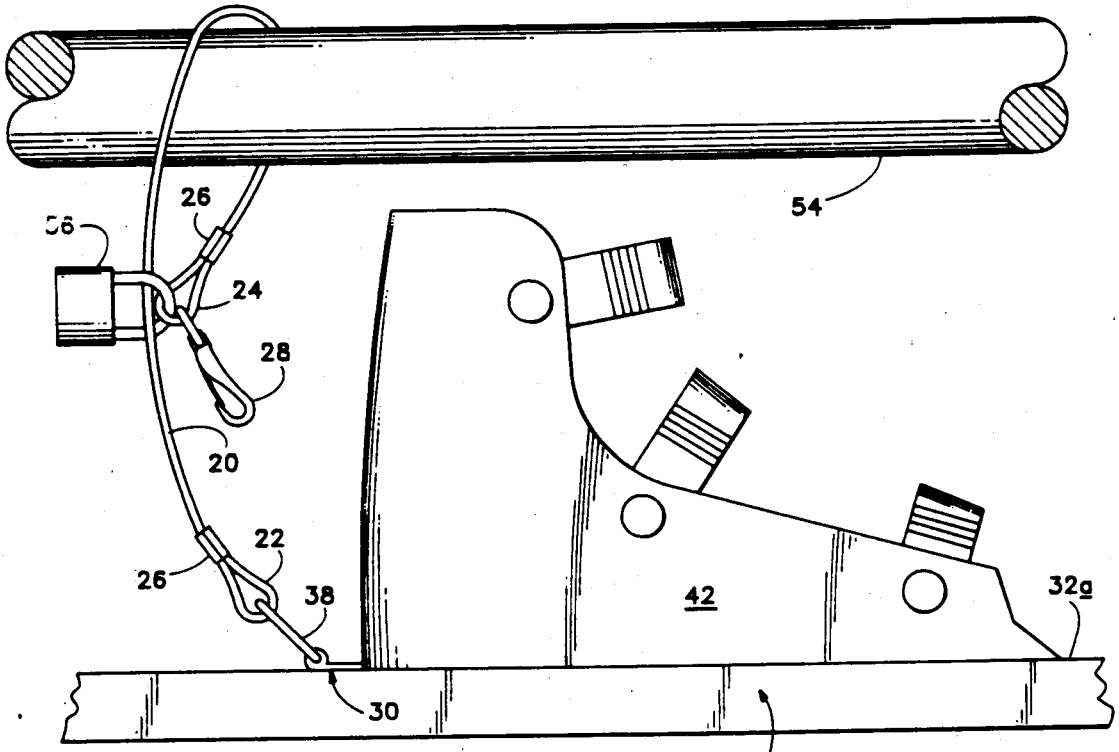
FIG. 6 is a side plan view of the safety strap of the invention used as a locking device for a snowboard.

Referring now to FIG. 6, snowboard 32 is depicted being secured to a fixed object, such as a rack 54. A lock 56 is secured through loop 24 and over cable 20, intermediate the ends thereof, to secure snowboard 32 to fixed object 54. Although it is recognized that making an item theft proof is near impossible, such an arrangement of safety strap !0 makes theft very difficult and, to that end, the material which is selected for cable 20 has a high tensile strength and is not readily cut by conventional pliers or side cutters.

Another feature of safety strap 10, which dictates that it be of relatively long length, is the ability of safety strap 10 to be used as a carrying strap or handle. To this end, a second fastener. 58, which is constructed similarly to fastens 30 or 46, is located in the region of a rear binding 60, at a location distant from where the first fastener is secured to the snowboard. Snap 28 may be connected to the D-ring in the second fastener and thereby provides a strap or handle which may be used to carry snowboard 32. As the snowboards are approximately 9-14 inches wide and 48 to 60 inches long, and may weigh as much as 30 pounds, carrying a snowboard, or several snowboards, can be quite awkward. The use of the safety strap as a handle or shoulder strap enables a user to carry one or more snowboards with relative ease.

Although a preferred embodiment, and several variations thereto, have been disclosed, it should be appreciated that further variations and modifications may be made to the safety strap of the invention without departing from the scope of the invention, as defined in the appended claims.

What I claim is:

1. A snowboard safety strap for use on a snowboard having a binding fixed thereon, comprising:

a fastener secured to the snowboard at a predetermined location between an upper surface of the snowboard and a lower surface of the binding which includes a tab, said tab having a first portion which contacts the upper surface of the snowboard and which has plural bores therethrough for securing said first portion to the snowboard, and a second portion, and a D-ring connector secured to said second portion for allowing connection of said cable to said tab;

a length of substantially non-elastic cable having a loop at each end thereof, the loop at one end of said cable being secured to said D-ring connector, and an attachment device attached to the loop at the other end thereof; and an elongate, adjustable-length web which extends about the user's leg, said web having loop-and-hook fasteners thereon to secure the ends of the web to one another about the user's leg, said web having a connection thereon, including a flap formed from a doubled portion of said web intermediate the ends thereof and having a D-ring fixed between the doubled portion for receiving said cable.

2. The safety strap of claim 1 wherein said cable has a predetermined length such that the cable may be extended around a fixed object, and the loop at the other end of the cable is constructed and arranged to receive a locking device therethrough, which locking device may be secured to said cable intermediate the ends thereof.

3. The safety strap of claim 1 wherein said cable is of sufficient length to extend from said fastener through said ring fixed to said web and back to said D-ring on said fastener.

4. The safety strap of claim 1 which includes a second fastener secured the snowboard at a location distant from the first mentioned fastener, and said cable is trainable from said first mentioned fastener to said second mentioned fastener to provide a carrying strap for a snowboard.

* * * * *